United States Patent [19]

Endo et al.

[11] Patent Number: 4,949,511

[45] Date of Patent: Aug. 21, 1990

[54] SUPER ABRASIVE GRINDING TOOL ELEMENT AND GRINDING TOOL

[75] Inventors: Yukio Endo, Yokohama; Kazuyuki Mitani, Tokyo; Tadashi Matsuoka, Kodaira; Masayoshi Ueki, Abiko; Norio Otake, Tokyo, all of Japan

[73] Assignees: Toshiba Tungaloy Co., Ltd.; Koya-Sha Co., Ltd.; Science and Creative Co., Ltd., Japan

[21] Appl. No.: 334,803

[22] Filed: Apr. 3, 1989

Related U.S. Application Data

[63] Continuation of Ser. No. 124,840, filed as PCT JP87/00084 on Feb. 10, 1987, published as WO87/04652 on Aug. 13, 1987, abandoned.

[51] Int. Cl.[5] ..... B24B 1/00

[52] U.S. Cl. ..... 51/295; 51/297; 51/307

[58] Field of Search ..... 51/295, 297, 307

[56] References Cited

U.S. PATENT DOCUMENTS

| | | | |
|---|---|---|---|
| 2,740,239 | 4/1956 | Ball et al. | 51/404 |
| 3,420,007 | 1/1969 | Kolesh | 51/295 |
| 3,495,359 | 2/1970 | Smith et al. . | |
| 3,535,729 | 10/1970 | Gervais | 51/295 |
| 3,547,608 | 12/1970 | Kitazawa | 51/295 |
| 3,597,887 | 8/1971 | Hall, Jr. | 51/295 |
| 3,607,159 | 9/1971 | Haywood | 51/295 |
| 4,543,106 | 9/1985 | Parekh | 51/295 |

FOREIGN PATENT DOCUMENTS 2068075 12/1980 United Kingdom .

*Primary Examiner*—Paul Lieberman
*Assistant Examiner*—Willie J. Thompson
*Attorney, Agent, or Firm*—Saidman, Sterne, Kessler & Goldstein

[57] ABSTRACT

This invention relates to a super abrasive grinding tool element and grinding tools having the element, the element being formed by bonding, with a resin system adhesive, super abrasive grains of diamond or the like to a mesh base so that the openings of the mesh base are kept open. In the element, there is sufficient cutting edge projection, a sufficient amount of coolant can be supplied, clogging is unlikely to occur, and high cutting efficiency can be maintained for a long time.

3 Claims, 5 Drawing Sheets

FIG. 6
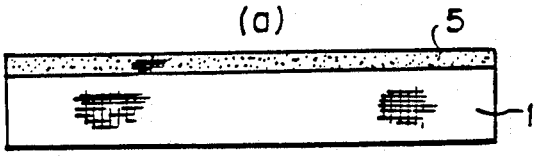
FIG. 7
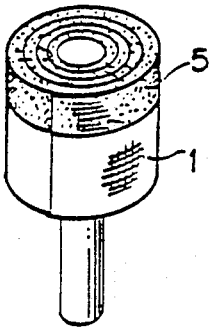
FIG. 8
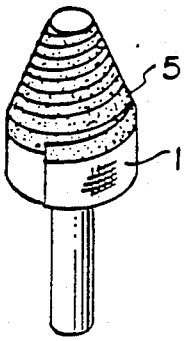
FIG. 9
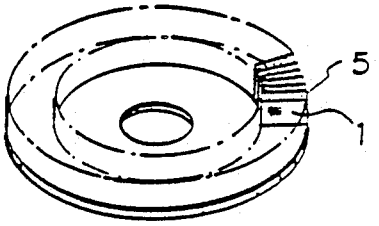
FIG. 10
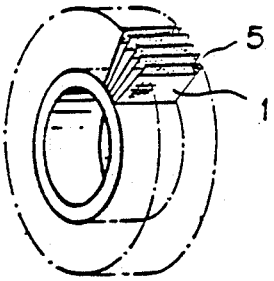
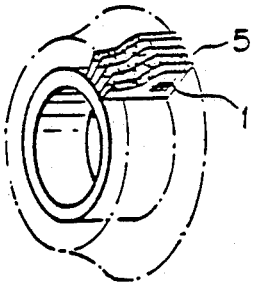
FIG. 11
FIG. 12
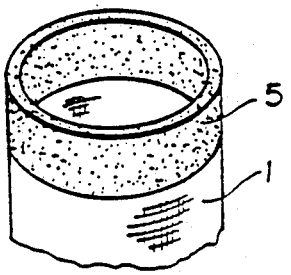

SUPER ABRASIVE GRINDING TOOL ELEMENT AND GRINDING TOOL

This application is a continuation of application Ser. No. 124,840, filed as PCT JP87/00084 on Feb. 10, 1987, published as WO87/04652 on Aug. 13, 1987, now abandoned.

TECHNICAL FIELD

This invention relates to an element of a super abrasive grinding tool such as a super abrasive grinding wheel for efficiently grinding a hard-to-grind material such as ceramics, hard metal, heat resisting steel, or high-speed steel, and to grinding tools having such an element.

BACKGROUND ART

There have been known super abrasive grinding tools having super abrasive grains of diamond, cubic boron nitride or the like as a grinding tool for cutting, shaving and/or abrading a hard-to-grind material such as ceramics, hard metal, heat resisting steel, or high-speed steel.

For example, as super abrasive grinding wheels for surface grinding, external grinding, internal grinding and the like of the hard-to-grind material, there have been known those which have metal-bonded, resin-bonded, vitrified or electro-deposited super abrasive layers and are divided into various kinds according to their shapes, e.g., straight, dish-like, cup-like, with a shaft or a segment grinding wheel, as defined in JIS B 4131 (Diamond or Cubic Boron Nitride Grinding Wheels).

However, in these super abrasive grinding wheels except those having the electro-deposited super abrasive layer, the abrasive grains are embedded in the bond, and there is almost no cutting edge projection, and accordingly, the grinding wheels must be frequently dressed during operation. Further, the metal-bonded and resin-bonded grinding wheels presently in wide use generally have no pore, that is, have no so-called chip pocket. Accordingly they are disadvantageous in that the discharge of cuttings and the supply of coolant cannot be satisfactorily effected, and the abrasive grains and the bond deteriorate due to clogging and heat, thereby lowering the grinding efficiency. Further, the super abrasive grinding wheels generally have high rigidity though there is slight difference among them depending on the material of the bond layer and the base metal bearing thereon the abrasive layer. The grinding wheel having a high rigidity is generally excellent in grinding accuracy but is disadvantageous in that the high rigidity causes chipping and/or fine cracks in the work surface, thereby lowering the quality of the work surface and making the grinding operation difficult. This is especially significant in grinding hard and fragile materials such as ceramics.

On the other hand, in the case of the grinding wheels having the electro-deposited super abrasive layer, the grinding efficiency can be better when the projection of the cutting edges of the abrasive grains from the bond layer is properly controlled. However, since the abrasive layer is of a single layer, as the abrasive grains are consumed to expose the base metal, the grinding resistance increases and grinding efficiency is greatly lowered, thus reducing the service life of such grinding wheels.

As cutting tips, e.g., throw-away cutting tips, there have been known those formed of hard metal, cermet, diamond, cubic boron nitride, alumina, silicon nitride and the like. These throw-away cutting tips are used for cutting steel, special steel and other metals, but it is difficult to cut so-called sintered advanced ceramics such as alumina, zirconia, silicon carbide, silicon nitride, and the like with the throw-away cutting tips. Accordingly, the super abrasive grinding wheels having the diamond abrasive grains described above are presently in wide use for cutting such materials. However, the conventional super abrasive grinding wheels having metal-bonded, resin-bonded, vitrified or electro-deposited super abrasive layers have the drawbacks described above.

DISCLOSURE OF INVENTION

The primary object of the present invention is to provide a super abrasive grinding tool element adapted to form a novel super abrasive grinding tool which is free from the drawbacks described above inherent to the conventional grinding tool like a super abrasive grinding wheel, i.e., insufficient projection of the cutting edges of the abrasive grains, a large area of contact of the working surface of the grinding wheel with the workpiece, insufficient supply of coolant to the processing part, lowering of grinding efficiency due to deterioration of the abrasive grains and/or clogging, lowering in grinding efficiency due to exposure of the metal base, and so on, and in which the application density of the abrasive grains is high, the abrasive layer acts on the workpiece constantly in an on and off fashion, a coolant can be sufficiently supplied, and an excellent grinding efficiency can be maintained for a long time, and to provide a grinding tool having such a grinding tool element.

In accordance with a first invention, there is provided a super abrasive grinding tool element which forms a unit of a super abrasive grinding tool such as a hacksaw, bandsaw, core drill, cartridge roll of various shapes, abrasive sleeve, flap wheel, hole cutter and grinding wheel of various shapes, and which is characterized by having an abrasive grain fixing portion formed by firmly bonding, with a resin system adhesive, super abrasive diamond grains or the like to both sides of a mesh base of inorganic fibers or synthetic organic fibers so that the openings of the mesh base are kept open. In the first invention, the mesh base is formed of inorganic fibers or synthetic organic fibers and is of 0.4 to 1.5 mm opening with a mesh density of 10 to 30. The abrasive grain fixing portion includes not less than 20% by weight of super abrasive grains, and the grains are bonded to the threads of the mesh base to wrap the threads. The blocked area of the openings of the mesh base is less than 75%.

That "the blocked area of the openings of the mesh base is less than 75%" means that the sum of the blocked area of the openings of the mesh base at the abrasive grain fixing portion is less than 75% of the total area of the openings at the abrasive grain fixing portion.

When the mesh base is a polygon in shape, the abrasive grain fixing portion is formed to a desired width from one edge or adjacent two edges of the polygon on both sides of the mesh base. When the mesh base is a polygon having a curved edges in shape, the abrasive grain fixing portion is formed to a desired width from the curved edge on both sides of the mesh base.

In accordance with a second invention, there is provided a super abrasive grinding tool which is in the form of a super abrasive grinding wheel having a single super abrasive grinding tool element in accordance with an embodiment of the first invention or a plurality of laminated super abrasive grinding tool elements in accordance with an embodiment of the first invention, the super abrasive grinding tool element in accordance with the embodiment of the first invention being characterized in that the mesh base is annular in shape and the abrasive grain fixing portion is formed on the outer peripheral edge or the inner peripheral edge of the annular mesh base.

When the number of the mesh bases is small, such as only one, the grinding wheel is mainly used for cutting, and when the number of the mesh bases is large, the grinding wheel is straight, dish-like, cup-like, ring-like or offset in shape and is used for grinding.

In accordance with a third invention, there is provided a super abrasive grinding tool which is in the form of a super abrasive grinding tip having a plurality of integrally laminated super abrasive grinding tool elements in accordance with an embodiment of the first invention, the super abrasive grinding tool element in accordance with the embodiment of the first invention being characterized in that the mesh base is polygonal or circular in shape and the abrasive grain fixing portion is formed on at least a part of the surface thereof.

In the super abrasive grinding tool element in accordance with the first invention which is formed by fixedly bonding super abrasive grains on a support material in the form of a mesh base so that the meshes of the mesh base are kept open, a number of fine cutting edges of the super abrasive grains project from the adhesive layer, a sufficient amount of coolant can be supplied through the meshes which are kept open, cuttings can be smoothly discharged and clogging is prevented. Further, by controlling the balance between the kind of mesh base, the kind and amount of adhesive, the application density of the abrasive grains and the like, super abrasive grinding tool elements varying in rigidity, from those having a high rigidity to those having a certain flexibility, can be obtained. Even those having a high rigidity can form a tool which acts on a workpiece with a certain cushioning effect to facilitate smooth processing differently from conventional tools.

Further, in the super abrasive grinding tools in accordance with the second and third inventions which are formed of the element in accordance with the first invention having the effects described above, a number of fine cutting edges of the super abrasive grains project, a sufficient amount of coolant can be supplied, cuttings can be smoothly discharged without clogging, and high cutting efficiency can be maintained for a long time. Further, since the mesh base is used as the support material, these super abrasive grinding tools act on a workpiece with a certain cushioning effect and accordingly there is little fear of lowering the quality of the work surface.

BRIEF DESCRIPTION OF THE DRAWINGS

FIGS. 6 to 12 are views showing several examples of grinding tools in which the super abrasive grinding tool elements in accordance with the first invention are employed, FIG. 6 being a plan view of a hacksaw, FIGS. 7 and 8 being perspective views of cartridge rolls with a shaft, FIG. 9 being a perspective view partly abbreviated of a cup-type grinding wheel, FIGS. 10 and 11 being perspective views partly abbreviated of flap wheels, and FIG. 12 being a perspective view of a hole cutter.

BEST MODE OF CARRYING OUT THE INVENTION

Embodiments of the present invention will be described in detail with reference to the drawings, hereinbelow.

The grinding tool elements in accordance with the first invention can be manufactured in the following manner, for instance.

(1) A mesh base which is a polygon or a polygon having a curved edge in shape is prepared.

(2) A prime coating of resin adhesive such as liquid phenol resin is applied on both sides of the mesh base.

(3) When the mesh base is a polygon in shape, super abrasive grains such as of diamond, cubic boron nitride or the like are applied to both sides of the mesh base in a desired width from one edge or adjacent two edges of the polygon. When the mesh base is a polygon having a curved side in shape, super abrasive grains such as of diamond, cubic boron nitride or the like are applied to both sides of the mesh base in a desired width from the curved edge. Then the resultant composite material is heated to dry the adhesive.

(4) Thereafter, the dried composite material is applied with overcoating of said resin adhesive and is heated to dry and partly harden the adhesive. This process should be effected so that the area of the openings of the mesh base blocked by the abrasive grains and the overcoating of adhesive is limited to less than 75% of the area of the openings.

(5) Then the resultant composite material is further heated for the amount of time needed to completely harden the resin, thereby forming a abrasive grain fixing portion. Thus, a grinding tool element is obtained.

Figure 1:
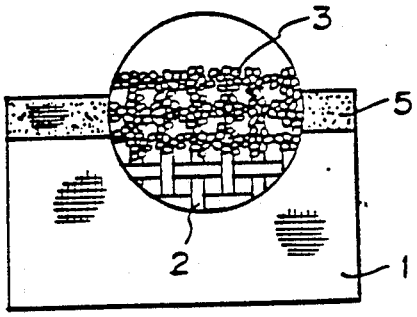
FIG. 1 is a plan view partly enlarged showing a super abrasive grinding tool element in accordance with an embodiment of the first invention.
Figure 2:
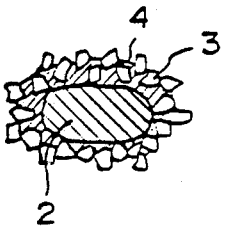
FIG. 2 is an enlarged cross-sectional view showing a part of the super abrasive grinding tool element.

As shown in FIGS. 1 and 2, the abrasive grains 3 are firmly bonded, by the adhesive 4, to the threads 2 of the mesh base 1 to wrap the threads 2 in one or more layers with cutting edges of the abrasive grains 3 projecting from the adhesive layer, thereby forming a adhesive grain fixing portion 5. Though the warp threads are normal to the weft threads in FIG. 1, a mesh base cut on the bias (45°) may be preferred depending on the purpose.

In order to ensure satisfactory discharge of cuttings and sufficient supply of coolant when the grinding tool element is used as an element for a bandsaw, a flap wheel, a grinding wheel or the like, it is preferred that the blocked area of the openings of the mesh base be less than 75% of the total area of the openings at the abrasive grain fixing portion. The fiber for forming the mesh base employed in the first invention may comprise one or more of inorganic high strength fibers such as glass fiber, carbon fiber, silicon carbide fiber, alumina fiber, mullite fiber, and metal fiber, and synthetic organic fibers such as aromatic polyamide fiber, nylon fiber, polyester fiber, vinylon fiber, phenolic fiber and rayon fiber. The mesh base may be composed of one of the fibers described above or of a textile blend or union fabric of two or more of the fibers described above. Preferably the mesh base is of 0.4 to 1.5 mm opening and has a warp and weft density of 10 to 30 mesh (number/25 mm). When the opening of the mesh base is equal to or larger than 1.5 mm and the warp and weft density is lower than 10 mesh, the application density of the abrasive grains on the surface of the mesh base becomes too low and grinding efficiency is lowered. On the other hand, when the opening of the mesh base is not larger than 0.4 mm and the warp and weft density is higher than 30 mesh, the meshes are substantially completely blocked and the object of the first invention cannot be accomplished. The abrasive grains employed in the first invention contain as the major component so-called super abrasive grains such as of diamond or cubic boron nitride. However, since the grinding tool element in accordance with the first invention is formed by applying abrasive grains to the support material in the form of a mesh base and accordingly the application density of the abrasive grains can be very high, normal abrasive grains can be used in place of a part of the super abrasive grains, which are expensive, without sacrificing grinding efficiency and durability, depending on the material of the workpiece. From the viewpoint of grinding efficiency and durability, a mixture of super abrasive grains and normal abrasive grains containing therein at least 20% by weight super abrasive grains can be used. The "normal abrasive grains" as used here include natural abrasive grains such as quartz, garnet, corundum and the like in addition to artificial grinding materials such as alumina, silicon carbide, alumina-zirconia and the like defined in JIS R 6111 (Artificial Abrasives).

The resin adhesive used in the first invention is selected from liquid resin adhesives which have resistance to heat and are of thermosetting resins such as resol phenol resins, modified phenol resins, epoxy resins, and polyimide resins, and is used together with various fillers.

In accordance with the first invention, by controlling the balance between the flexibility, the thread size and the warp and weft density of the mesh base, the hardness of the thermosetting adhesive, the application density of the abrasive grains and the like, grinding tool elements varying in rigidity, from those having a high rigidity to those having a certain flexibility, can be obtained.

FIGS. 1 to 5 show examples of grinding tool elements in accordance with the first invention, and various grinding tools formed of the elements are shown in FIGS. 6–12.

Figure 3:
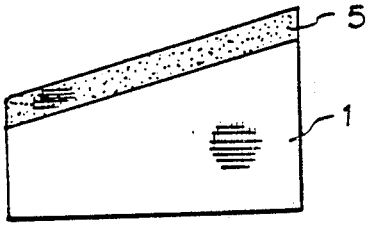
FIGS. 3, 4 and 5 are plan views respectively showing other embodiments of the first invention.
Figure 4:
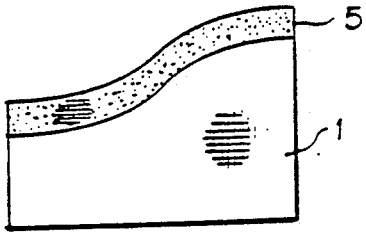
Figure 5:
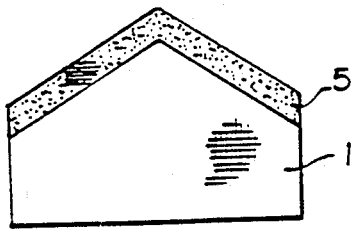

Grinding tool elements which are ribbon-like (strip-like) in shape are used as the cutting edge of a hacksaw, bandsaw or core drill, or wound a plurality of turns to be used as a hole cutter. Those which are rectangular in shape are radially built on a cylindrical base and are used as an abrasive flap wheel, or are wound around and fixed to a thin shaft to be used as a cartridge roll with a shaft. In order to grind a contoured surface or in order to simultaneously grind a pair of surfaces perpendicular to each other, the grinding tools shown in FIGS. 3–5 are used.

By use of one or a plurality of the grinding tool elements in accordance with the first invention, together with spacers of suitable material if necessary, abrasive flap wheels with shafts as defined in JIS R 6258; abrasive flap wheels with incorporated flanges or separate flanges defined in JIS R 6259; shaped flap wheels having shaped working surfaces; cylindrical abrasive sleeves as defined in JIS R 6257; and a truncated cone abrasive sleeves as defined in ISO 2422 can be formed with ease. The shapes of the grinding tool having the grinding tool element of the first invention may be, in addition to those described above, those defined in JIS R 6211 (Shapes and Dimensions of Grinding Wheels), e.g., straight, ring-like, recessed, cup-like, dish-like, offset, wedged, disc-like, various mounted wheels, and those defined in JIS R 6218 (Segment Grinding Wheels), i.e., various segment grinding wheels.

More concrete embodiments of the first invention will be described, hereinbelow.

(EMBODIMENT)

A rectangular leno weave mesh base with a size of 30 mm×50 mm, a thickness of 0.18 mm, of glass fiber and of 20 mesh was impregnated with liquid resol phenol resin adhesive, mixed with silica fine powder filler so as not to block the openings, heated to dry, and then a prime coating of adhesive of the same system as the adhesive described above was applied to it. Thereafter, diamond abrasive grains of #140/170 grain size were coated on both sides of the mesh base to a width of 5 mm from one of the longer edges, and then the resultant composite material was heated to dry and was applied with overcoating of adhesive of the same system as the adhesive described above. Thereafter, the composite material was heated and the over coating was partly hardened. The blocked area of the meshes of the mesh base blocked by the abrasive grains and the overcoating adhesive was about 50%, and the thickness of the portion coated with the abrasive grains was 0.7 mm. The composite material thus obtained was wound around a 6 mmØ shaft and bonded thereto by adhesive, and then heated to completely harden the resin, whereby a super abrasive cartridge roll with a shaft was obtained.

When the inner surface of a sintered silicon nitride tube was ground by the wet method with the cartridge roll at 12000 rpm, a sufficient amount of coolant could be supplied to the processing portion through the open meshes and cuttings could be smoothly discharged through the open meshes without clogging. Further, the cartridge roll exhibited an excellent grinding efficiency lasting long, and grinding operation was effected with an efficiency higher than with any one of conventional tools.

Embodiments of the second invention will be described, hereinbelow.

The super abrasive grinding tool in accordance with the second invention can be manufactured in the following manner, for instance.

(1) An annular mesh base is primed with resin adhesive, e.g., liquid phenol resin, on both sides thereof.

(2) A super abrasive layer is applied to both sides of the annular mesh base to a desired width from the outer peripheral edge or the inner peripheral edge according to the purpose, and is heated to dry the adhesive.

(3) Thereafter, the dried composite material is applied with overcoating of resin adhesive substantially equal to said resin adhesive in quality and is heated to dry and partly harden the adhesive. This process should be effected so that the area of the openings of the mesh base blocked by the abrasive grains and the overcoating adhesive is limited to less than 75% of the area of the openings.

(4) Then the composite material bearing thereon partly hardened overcoating adhesive is inserted into a mold comprising a pair of metal discs, heated to completely harden the resin, and then removed from the mold.

(5) If necessary, the outer peripheral edge or the inner peripheral edge of the composite material thus obtained is finished and a super abrasive grinding wheel for cutting is obtained.

A plurality of the composite materials obtained as a result of steps (3) or (4) may be impregnated with resin adhesive and laminated into a desired shape and size, according to the intended purpose, and hot-pressed by the use of a pair of metal discs or a metal mold to completely harden the resin so as to integrate the composite materials, thereby forming a straight grinding wheel or a grinding wheel of other shapes.

Before the step (1) for priming the mesh base with adhesive, the mesh base may be modified by applying adhesive of the same system in order for increase in rigidity and/or for sealing, if necessary.

Figure 13:
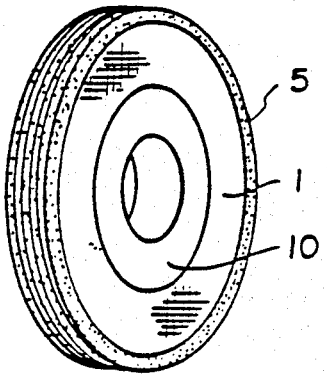
FIG. 13 is a plan view partly abbreviated of a super abrasive grinding wheel in accordance with an embodiment of the second invention.
Figure 14:
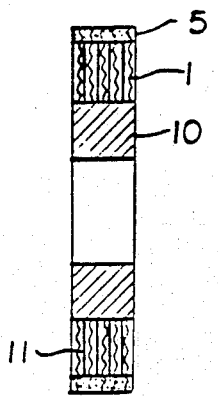
FIG. 14 is an enlarged view showing a part of the super abrasive grinding wheel.
Figure 15:
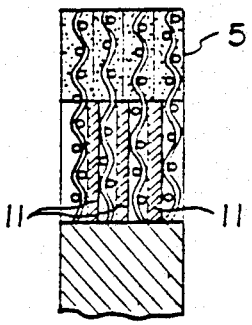
FIG. 15 is a perspective view showing a straight grinding wheel in accordance with another embodiment of the second invention.

The abrasive grains 3 are firmly bonded to the mesh base by the adhesive 4 to form an abrasive grain fixing portion 5 with one or a plurality of abrasive layers wrapping the threads 2 of the mesh base 1 and the cutting edges of the abrasive grains 3 projecting as shown in FIGS. 13 and 14.

It is preferred that the area of the openings of the mesh base blocked by the abrasive grains and the adhesive be limited to less than 75% of the area of the openings in order to supply a sufficient amount of coolant and to smoothly discharge cuttings.

The fiber for forming the mesh base, the mesh of the mesh base, the abrasive grains, and the resin adhesive in the second invention may be the same as those employed in the first invention.

Further, in order to increase the rigidity as a grinding wheel for cutting, it is effective to bond fine powder of silicon carbide abrasive material or alumina abrasive material, or fine powder of a solid lubricant such as molybdenum disulfide or graphite by adhesive of the same system as that described above to a part other than the super abrasive grain fixing portion 5 in a thickness not larger than the thickness of the super abrasive layer.

Figure 19:
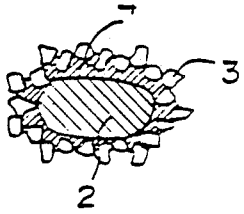
FIG. 19 is a vertical cross-sectional view showing a still another embodiment of the second invention.
Figure 20:
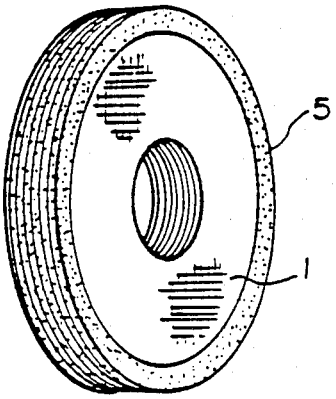
FIG. 20 is a view for illustrating an example of a method of manufacturing the embodiment shown in FIG. 19, FIGS. 21, 22 and 23 are perspective views showing super abrasive grinding tips in accordance with various embodiments of the third invention.

Further, the super abrasive grinding tool of the second invention may be arranged as shown in FIG. 8. As can be better understood from FIGS. 17 and 18, the grinding wheel shown in FIG. 16 differs from that shown in FIG. 7 in that a central hub 10 is provided and reinforcements 11 are inserted between the mesh bases 1. Only the reinforcements 11 may be provided as shown in FIG. 19. The reinforcement 11 may be provided by, for instance, sandwiching the reinforcements 11 between the mesh bases 1 as shown in FIG. 20 and then integrating them by compression-molding.

As the material for the hub 10, a metal such as iron, stainless steel or aluminum alloy, or a synthetic resin such as bakelite or FRP is suitable. As the reinforcements 11 described above, mesh-like members formed of inorganic fiber, synthetic organic fiber or fine metal wire, a thin metal plate, a thin perforated metal plate, a thin synthetic resin plate or a thin FRP plate is suitable.

In the super abrasive grinding wheel in accordance with the second invention, a sufficient amount of coolant can be supplied to the processing portion through the open meshes and cuttings can be smoothly discharged through the open meshes without clogging. Further, since the cutting edge projection is sufficient and the abrasive grains are firmly bonded to the base, the grinding wheel of the second invention exhibits an excellent grinding efficiency lasting long, and grinding or cutting operation can be effected with a high efficiency The tools described in conjunction with the first invention may be provided with the hub and/or the reinforcement, if necessary.

More concrete embodiments of the second invention will be described, hereinbelow.

(EMBODIMENT 1)

A leno weave glass fiber mesh sheet with a thickness of 0.18 mm and of 20 opening was impregnated with liquid resol phenol resin adhesive, mixed with silica fine powder filler so as not to block the openings, in order to increase rigidity and sealing's strength, and heated to dry. Thereafter, a circular mesh base having a diameter of 100 mm and a predetermined mounting hole was cut from the mesh sheet, and then a prime coating of adhesive of the same system as the adhesive described above was applied to it. Thereafter, diamond abrasive grains of #140/170 grain size were coated on both sides of the mesh base to a width of 10 mm from the outer peripheral edge and then the resultant composite material was heated to dry the adhesive and an overcoating of adhesive of the same system as the adhesive described above was applied to the composite material. Thereafter, the composite material was heated and the over coating was partly hardened. The resultant material was inserted into a mold comprising a pair of metal discs, heated under pressure to completely harden the resin, and then removed from the mold, thereby obtaining a circular grinding wheel for cutting. About 50% of the area of the openings of the mesh base was blocked by the abrasive grains and the overcoating adhesive, and the thickness of the portion coated with the abrasive grains was 0.7 mm, with the thickness of the portion free from the abrasive grains being 0.5 mm.

When a 5 mm thick sintered silicon nitride plate was cut by the wet method with the super abrasive grinding wheel at 5600 rpm, a sufficient amount of coolant could be supplied to the cutting portion through the open meshes and cuttings could be smoothly discharged through the open meshes without clogging. Further, the grinding wheel exhibited excellent cutting efficiency.

(EMBODIMENT 2)

Sixteen composite materials obtained by partly hardening the overcoating adhesive in embodiment 1 were superposed on one another and hot-pressed between a pair of metal plate molds to completely harden the resin. Thereafter the integrated composite materials were removed from the molds, whereby a 10 mm thick straight grinding wheel was obtained.

When a 5 mm thick sintered silicon nitride plate was cut by the wet method with the grinding wheel at 4200 rpm with a workpiece feed rate of 2 m/min and a cutting depth of 0.1 mm, a sufficient amount of coolant could be supplied to the grinding portion and cuttings could be smoothly discharged through the open meshes without clogging. Further, the grinding wheel exhibited excellent cutting efficiency.

Embodiments of the third invention will be described, hereinbelow.

The super abrasive grinding tip in accordance with the third invention can be manufactured in the following manner, for instance.

(1) A piece of mesh base shaped according to the intended purpose is primed with resin adhesive, e.g., liquid phenol resin, on both sides thereof.
(2) Abrasive grains are applied to both sides of the mesh base over the entire area or to a desired width from the outer edge and is heated to dry the adhesive.
(3) Thereafter, the dried composite material has an overcoating of said resin adhesive applied to it and the composite material is heated to dry and partly harden the overcoating of adhesive.
(4) Then a plurality of the composite materials thus obtained are superposed on one another to a desired width according to the intended purpose with the outer edges being aligned with each other as they are or after being impregnated with resin adhesive, and hot-pressed in a mold to completely harden the resin. Thereafter the integrated composite materials are removed from the mold, whereby a grinding tip is obtained.

Before step (1), in which the mesh base is primed with adhesive, the mesh base may be modified by applying adhesive as described above of the same system in order to increase rigidity and/or sealing strength, if necessary.

Before being superposed and hot-pressed, the abrasive grains 3 are firmly bonded to the mesh base by the adhesive 4 to form an abrasive grain fixing portion 5 with one or a plurality of abrasive layers wrapping the threads 2 of the mesh base 1 and the cutting edges of the abrasive grains 3 projecting as shown in FIGS. 13 and 14. It is preferred that the area of the openings of the mesh base blocked by the abrasive grains and the adhesive be limited to less than 75% of the area of the openings in order to supply a sufficient amount of coolant and to smoothly discharge cuttings.

The fiber for forming the mesh base, the opening of the mesh base, the abrasive grains, and the resin adhesive in the third invention may be the same as those employed in the first invention.

Figure 16:
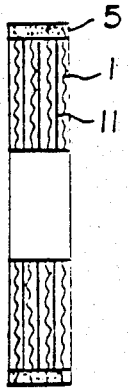
FIG. 16 is a perspective view showing still another embodiment of the second invention.
Figure 17:
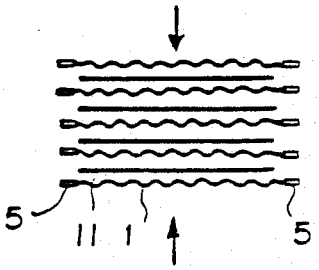
FIG. 17 is a vertical cross-sectional view of FIG. 16.
Figure 18:
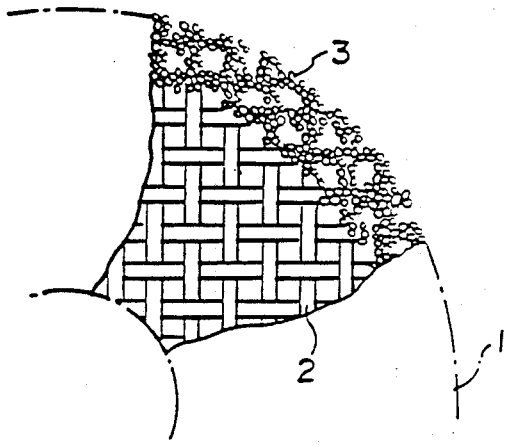
FIG. 18 is an enlarged view of a part of FIG. 17.
Figure 21:
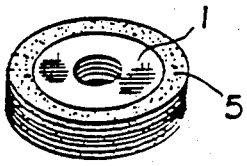
Figure 22:
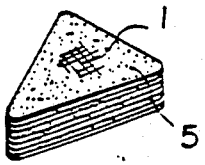
Figure 23:
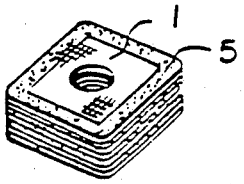
Figure 24:
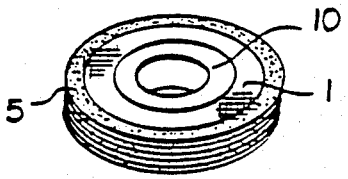
FIGS. 24 and 25 are perspective views showing super abrasive grinding tips in accordance with other embodiments of the third invention.
Figure 25:
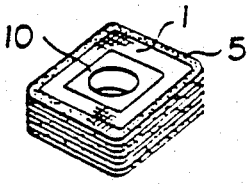

FIGS. 21(*a*), 22(*b*) and 23(*c*) respectively show tips formed in the manner described above, and FIGS. 24 and 25 respectively show tips having hubs 10 and reinforcements [not shown in FIGS. 24 and 25] similar to those shown in FIGS. 16 to 18 in conjunction with the second invention. As shown in the figures, the super abrasive grinding tips are circular, triangular or rectangular in shape and each said tip is provided with a central mounting hole, as desired. Further, if necessary, a mounting shank may be fixed to the tip at the center thereof.

The super abrasive grinding tip in accordance with the third invention may be used as, for example, a throw-away tip for a circular mill or a face mill. The action of the tip on the work surface is not so-called cutting but on-and-off grinding.

In the grinding tip of the third invention which is formed by integrally laminating a plurality of the super abrasive grinding tool elements in accordance with the first invention which is formed by fixedly bonding super abrasive grains on a support material in the form of a mesh base so that the openings of the mesh base are kept open, when a plurality of the grinding tips are mounted on a mounting jig and used for grinding, a number of fine cutting edges of the super abrasive grains projecting from the adhesive layer act on the workpiece, sufficient amount of coolant can be supplied through the openings which are kept open, cuttings can be smoothly discharged without clogging and an excellent grinding efficiency which can be maintained for a long time can be enjoyed. Further, by controlling the balance between the kind of mesh base, the kind and amount of adhesive, the application density of the abrasive grains and the like, super abrasive grinding tool elements varying in rigidity, from those having a high rigidity to those having a certain flexibility, can be obtained. Even those having a high rigidity can form a tool which acts on a workpiece with a certain cushioning effect which facilitates processing which is smoother than that carried out by conventional tools.

More concrete embodiments of the third invention will be described, hereinbelow.

(EMBODIMENT)

A vinylon fiber mesh sheet with a thickness of 0.18 mm and of 0.9 mm opening with a mesh density of 20 mesh and which had been impregnated with resol phenol resin adhesive mixed with silica fine powder filler in order to strengthen sealing had a prime coating of adhesive of the same system as the adhesive described above applied to it. Thereafter, diamond abrasive grains of #80/100 grain size were coated on both sides of the mesh base to a width of 2 mm from the outer edge and then the resultant composite material was heated to dry the adhesive, and then the composite material had an overcoating of adhesive of the same system as the adhesive described above applied to it. The mesh base was annular in shape and had an outer diameter of 20 mm and a central hole which was 6 mm in diameter. Thereafter, the composite material was heated and the overcoating of adhesive was partly hardened. About 50% of the area of the openings of the mesh base was blocked by the abrasive grains and the overcoating adhesive, and the thickness of the portion coated with the abrasive grains was 0.8 mm. The eighteen composite materials thus obtained were superposed on one another with the outer edges being aligned with each other and hot-pressed to a thickness of 7 mm in a mold, and further heated to completely harden the resin. After being integrated together, the composite materials were removed from the mold, thereby obtaining a tip 20 mm in diameter and 7 mm in thickness.

Eight tips obtained in the manner described above were mounted on a face milling cutter, and 20 mm thick silicon nitride ceramics were processed by a vertical milling machine at 1300 m/min with a workpiece feed rate of 30 mm/min and a cutting depth of 3 mm. It was been found that the tips exhibited an excellent cutting efficiency which could be maintained for a long time, and processing was effected with an efficiency higher than with any one of the conventional tools.

Further, when the super abrasive grinding tip was mounted on a tool holder and was applied to a processing system in which the tool was kept stationary and the material-to-be-ground was rotated, a result similar to that in the processing system described above, in which the tool was rotated, was obtained.

The super abrasive grinding tip in accordance with the third invention can cut even ceramics, hard metal and the like which cannot be cut by the conventional throw-away tips, exhibits an excellent cutting efficiency which can be maintained for a long time, unlike the conventional super abrasive grinding wheels, and enables efficient machining. Especially as compared with the conventional diamond grinding wheel having a high rigidity, the tip in accordance with the third invention having diamond abrasive grain resiliently acts on the work surface when processing hard and fragile material such as advanced ceramics, and accordingly a high quality surface free from chipping and/or fine cracks can be obtained.

We claim:

1. A super abrasive grinding tool comprising a plurality of integrally laminated grinding elements, each of said grinding elements comprising:

a mesh base, said mesh base being formed of threads composed of organic or synthetic organic fibers, said threads being spaced 0.4–1.5 mm apart from each other to form openings in said mesh base, said mesh base having a mesh density of 10–30 mesh; and a super-abrasive grain fixing portion, said super-abrasive grain fixing portion including super-abrasive grains such as diamond or cubic boron nitride, said super-abrasive grain fixing portion further including a resin adhesive, said super-abrasive grain fixing portion being bonded together and fixed to at least a part of said mesh base such that said threads are wrapped with said super-abrasive grains, wherein the area of said openings blocked by said super-abrasive grain fixing portion is less than 75%, and wherein said openings permit cuttings and air to pass therethrough.

2. A super-abrasive grinding tool as set forth in claim 1, wherein said mesh base is anular and said super-abrasive grain fixing portion is fixed to one of an outer peripheral edge portion or an inner peripheral edge portion of said mesh base.

3. A super-abrasive grinding tool as set fort in claim 1, wherein said mesh base is selected from one of the group consisting of a polygon or a circle, and said super-abrasive grain fixing portion is fixed to at least a part of the surface of said mesh base.

* * * * *